US011761604B2

(12) United States Patent
Larimian et al.

(10) Patent No.: US 11,761,604 B2
(45) Date of Patent: Sep. 19, 2023

(54) MOTOR VEHICLE HEADLIGHT SYSTEM

(71) Applicant: ZKW Group GmbH, Wieselburg (AT)

(72) Inventors: Reza Larimian, Vienna (AT); Stefan Miedler, Unterradlberg (AT); Thomas Reiter, Ferschnitz (AT); Alexander Hacker, Wilhelmsburg (AT); Christian Jackl, Wieselburg (AT); Bettina Reisinger, Amstetten (AT); Christian Bemmer, Klein-Pöchlarn (AT)

(73) Assignee: ZKW Group GmbH, Wieselburg (AT)

( * ) Notice: Subject to any disclaimer, the term of this patent is extended or adjusted under 35 U.S.C. 154(b) by 0 days.

(21) Appl. No.: 17/923,646

(22) PCT Filed: Apr. 20, 2021

(86) PCT No.: PCT/EP2021/060200
§ 371 (c)(1),
(2) Date: Nov. 7, 2022

(87) PCT Pub. No.: WO2021/233620
PCT Pub. Date: Nov. 25, 2021

(65) Prior Publication Data

US 2023/0204181 A1 Jun. 29, 2023

(30) Foreign Application Priority Data

May 19, 2020 (EP) ..... 20175378

(51) Int. Cl.
*F21S 41/663* (2018.01)
*F21S 41/153* (2018.01)

(52) U.S. Cl.
CPC ..... *F21S 41/663* (2018.01); *F21S 41/153* (2018.01)

(58) Field of Classification Search
CPC ..... F21S 41/153; F21S 41/663; B60Q 1/04
See application file for complete search history.

(56) References Cited

U.S. PATENT DOCUMENTS 10,596,956 B1 * 3/2020 Ahn ..... B60Q 1/2607
2014/0009938 A1 1/2014 Hossfeld
(Continued)

FOREIGN PATENT DOCUMENTS

DE 102017206274 A1 10/2018
DE 102017216911 A1 3/2019

OTHER PUBLICATIONS

International Search Report for PCT/EP2021/060200, dated Jun. 29, 2021 (13 pages).
(Continued)

*Primary Examiner* — Eric T Eide
(74) *Attorney, Agent, or Firm* — Eversheds Sutherland (US) LLP

(57) ABSTRACT

A motor vehicle headlamp system with a first and a second motor vehicle headlamp, wherein each motor vehicle headlamp comprises a first and a second light module, which first light module comprises light pixels, and is arranged to generate a first light distribution (100), and wherein the second light module comprises light pixels, and is arranged to generate a second light distribution (200), wherein each light distribution (100, 200) is formed from several pixel light segments (101, 201), wherein a pixel light segment (101, 201) corresponds to a light pixel and is able to be produced through this, wherein each light distribution (100, 200) is arranged to generate a first pixel light segment group (110, 210) with a first column width (110*a*, 210*a*), to generate a second pixel light segment group (120, 220) with a second column width (120*a*, 220*a*), which corresponds to ½ of the first column width (110*a*, 210*a*), to generate a third pixel light segment group (130, 230) with a third column width (130*a*, 230*a*), (Continued)

Figure 1:
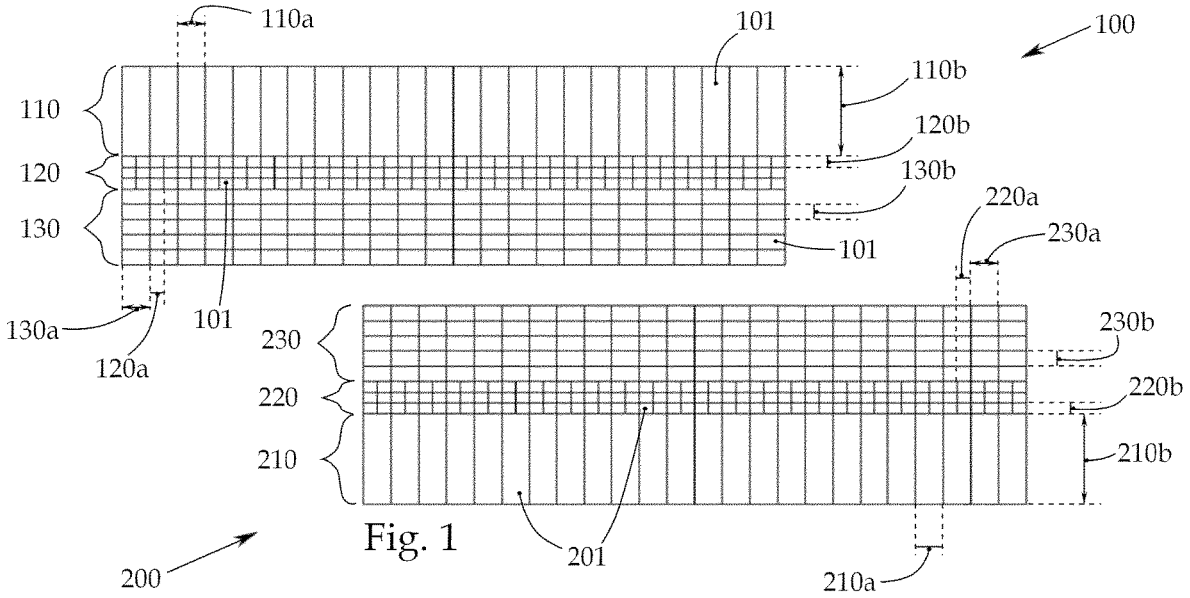

wherein in the first light distribution (100), in vertical direction, the first pixel light segment group (110) is arranged above the second pixel light segment group (120) and the third pixel light segment group (130) is arranged beneath, and wherein the second light distribution (200) is arranged mirrored vertically with respect to the first light distribution (100), wherein the first motor vehicle headlamp is arranged to overlap the first and the second light distribution (100, 200) by a vertical offset (301) of half of the third column height (130*b,* 230*b*) with formation of a first headlamp light distribution (310), wherein the second motor vehicle headlamp is arranged to overlap the first and the second light distribution (100, 200) with formation of a second headlamp light distribution (320), wherein the second headlamp light distribution (320) is mirrored horizontally with respect to the first headlamp light distribution (310), wherein the first headlamp light distribution (310) and the second headlamp light distribution (320) are arranged overlapping one another by a horizontal offset (401) of ½ of the first column width (110*a,* 210*a*) with formation of a motor vehicle headlamp system light distribution (400).

10 Claims, 2 Drawing Sheets

(56) References Cited

U.S. PATENT DOCUMENTS

| | | | | |
|---|---|---|---|---|
| 2018/0283641 | A1 | 10/2018 | Courcier et al. | |
| 2019/0016251 | A1 | 1/2019 | Roels et al. | |
| 2019/0234571 | A1 | 8/2019 | Gromfeld | |
| 2022/0057065 | A1* | 2/2022 | Reisinger ..... | F21S 41/255 |

OTHER PUBLICATIONS

Search Report for European Patent Application No. 20175378.7 dated Nov. 2, 2020 (5 pages).

* cited by examiner

MOTOR VEHICLE HEADLIGHT SYSTEM

The invention relates to a motor vehicle headlamp system with a first and a second motor vehicle headlamp, wherein each motor vehicle headlamp comprises a first and a second light module, which first light module comprises light pixels in a matrix-like arrangement in lines and columns, and is arranged to generate a first light distribution before the motor vehicle headlamp system by radiating of light of individual light pixels, and wherein the second light module comprises light pixels in a matrix-like arrangement in lines and columns, and is arranged to generate a second light distribution before the motor vehicle headlamp system by radiating of light of individual light pixels, wherein each light distribution is formed from several pixel light segments, wherein a pixel light segment corresponds to a light pixel and is able to be generated through this.

In the prior art, light-emitting diodes are usually used for the generation of one or more light distributions, which light-emitting diodes or respectively LEDs are arranged in a matrix-like manner in lines and columns, wherein the light-emitting diodes or respectively LEDs are also designated as pixels or respectively light pixels.

In order to obtain a higher resolution of the light distribution, therefore the pixels containing in the light distribution—also designated as pixel light segment—, at the same time the number of the light-emitting diodes or respectively LEDs is increased and/or the size of the LEDs is further reduced, in order to obtain an increased resolution on the same installation space. Thereby, however, a high electronic complexity arises owing to the high number of pixels or respectively LEDs which are to be activated.

Furthermore also with the use of a single light module, the intensity of the individual LEDs must be high on generating a light distribution, in order to achieve the required legal intensity. This leads, inter alia, to high temperatures within the light module or respectively the LED array which, in turn, must be especially cooled. Moreover, a legal light distribution width or respectively the view field (also designated "field of view") must also be maintained on generating of a light distribution, as dipped beam distribution and/or full beam distribution.

On implementation by a single light module, this is disadvantageous owing to the in turn increased electronic complexity and heat development.

It is an object of the invention to provide an improved motor vehicle headlamp system.

This problem is solved in that each light distribution is arranged

- to generate a first pixel light segment group, which is arranged in a matrix-like manner in lines and columns with a first column width and a first line height,
- to generate a second pixel light segment group, which is arranged in a matrix-like manner in lines and columns with a second column width and a second line height, wherein the second column width corresponds to half of the first column width,
- to generate a third pixel light segment group, which is arranged in a matrix-like manner in lines and columns with a third column width and a third line height, which third column width corresponds to the first column width, wherein in the first light distribution of the first light module the pixel light segment groups are arranged in vertical direction over one another, wherein the first pixel light segment group is arranged in vertical direction above the second pixel light segment group, and the third pixel light segment group is arranged in vertical direction beneath the second pixel light segment group, and wherein the second light distribution of the second light module is arranged mirrored vertically to the first light distribution, so that the third pixel light segment group is arranged in vertical direction above the second pixel light segment group and the first pixel light segment group is arranged in vertical direction beneath the second pixel light segment group, wherein the first and the second light module of the first motor vehicle headlamp are arranged and disposed with respect to one another, that the first and the second light distribution of the first motor vehicle headlamp are arranged by a vertical offset of half the second line height at least partially overlapping one another with the formation of a first headlamp light distribution, and wherein the first and the second light module of the second motor vehicle headlamp are arranged and disposed with respect to one another, that the first and the second light distribution of the second motor vehicle headlamp at least partially overlap one another with formation of a second headlamp light distribution, wherein the second headlamp light distribution is mirrored horizontally to the first headlamp light distribution, and wherein the first and the second motor vehicle headlamp are arranged and disposed with respect to one another, that the first headlamp light distribution of the first motor vehicle headlamp and the second headlamp light distribution of the second motor vehicle headlamp overlap one another by a horizontal offset of by half the first pixel width to a motor vehicle headlamp system light distribution.

By overlapping of identical but mirrored light distributions or respectively part light distributions, not only the view field ("field of view") but also the resolution and the homogeneity of the overall light distribution or respectively of the motor vehicle headlamp system light distribution can be improved. Thereby, inter alia sharp light-dark boundaries can be produced, although the resolution of an individual light module would be too small.

Provision can be made that the first and the second light module of the first motor vehicle headlamp are arranged and disposed with respect to one another, that the first and the second light distribution of the first motor vehicle headlamp additionally at least partially overlap one another by a horizontal offset of at least one quarter of the first column width.

Provision can be made here that the horizontal offset is a multiple of a quarter of the first column width.

Provision can be made that the first pixel light segment group has a first line height, the second pixel light segment group has a second line height and the third pixel light segment group has a third line height, wherein the line heights are different from one another.

Provision can be made that the first line height is greater than the second and the third line height, and wherein the third line height is greater than the second line height.

Provision can be made that the light pixels of the first and second light modules are formed from LEDs.

Provision can be made that the number of the light pixels of a light module is a maximum of 400.

Provision can be made that the light pixels of the first and second light modules are configured as mini LEDs.

A differentiation is to be made here between micro LEDs and mini LEDs. Micro LEDs are smaller by an order of magnitude than mini LEDs, wherein mini LEDs have a size substantially in the region of 100 μm.

Micro LEDs are generally more difficult to produce and are thereby also more cost-intensive. Mini LEDs, on the other hand, are substantially easier to produce.

Provision can be made that the motor vehicle headlamp system comprises a control device which is arranged to activate the light pixels of the first and second light modules, wherein the light pixels are able to be activated independently of each other.

Provision can be made that the control device is arranged to activate the light pixels of the first and second light modules such that a dipped beam distribution and/or a full beam distribution is able to be generated in the motor vehicle headlamp system light distribution.

The invention is explained more closely in the following with the aid of exemplary drawings. There are shown here FIG. 1 an exemplary first and second light distribution of a first or respectively of a second motor vehicle headlamp, FIG. 2 an exemplary first headlamp light distribution, which is able to be generated by means of an overlapping of the first and second light distribution of a first motor vehicle headlamp, FIG. 3 an exemplary second headlamp light distribution, which is able to be generated by means of an overlapping of the first and second light distribution of a second motor vehicle headlamp, FIG. 4 an exemplary motor vehicle headlamp system light distribution, which is able to be generated by means of an overlapping of the first and second headlamp light distributions of FIGS. 2 and 3.

FIG. 1 shows an exemplary first and second light distribution 100, 200 of a motor vehicle headlamp system with a first and a second motor vehicle headlamp, wherein each motor vehicle headlamp comprises a first and a second light module, which first light module comprises light pixels in a matrix-like arrangement in lines and columns, and is arranged to generate the first light distribution 100 before the motor vehicle headlamp system by radiating of light of individual light pixels, and wherein the second light module comprises light pixels in a matrix-like arrangement in lines and columns, and is arranged to generate the second light distribution 200 before the motor vehicle headlamp system by radiating of light of individual light pixels.

Here, the light pixels of the light modules are configured as mini LEDs and do not exceed the number of 400 in a light module.

Each light distribution 100, 200 is formed here from several pixel light segments 101, 201, wherein a pixel light segment 101, 201 corresponds to a light pixel and is able to be produced through this.

Furthermore, each light distribution 100, 200 is arranged to generate a first pixel light segment group 110, 210, which is arranged in a matrix-like manner in lines and columns with a first column width 110*a*, 210*a*, and to generate a second pixel light segment group 120, 220, which is arranged in a matrix-like manner in lines and columns with a second column width 120*a*, 220*a*, wherein the second column width 120*a*, 220*a* corresponds to half of the first column width 110*a*, 210*a*, and to generate a third pixel light segment group 130, 230, which is arranged in a matrix-like manner in lines and columns with a third column width 130*a*, 230*a*, which corresponds to the first column width 110*a*, 210*a*.

Furthermore, the first pixel light segment group 110, 210 has a first line height 110*b*, 210*b*, the second pixel light segment group 120, 220 has a second line height 120*b*, 220*b* and the third pixel light segment group 130, 230 has a third line height 130*b*, 230*b*, wherein in the example which is shown the first line height 110*b*, 210*b* is greater than the second and the third line height 120*b*, 220*b*, 130*b*, 230*b*, and wherein the third line height 130*b*, 230*b* is greater than the second line height 120*b*, 220*b*.

As can be seen in FIG. 1, the pixel segment groups 110, 120, 130 in the first light distribution 100 of the first light module are arranged over one another in vertical direction, wherein in vertical direction above the second pixel light segment group 120 the first pixel light segment group 110 is arranged, and in vertical direction beneath the second pixel light segment group 120 the third pixel light segment group 130 is arranged.

Furthermore it can be seen that the second light distribution 200 of the second light module is arranged mirrored vertically with respect to the first light distribution 100, so that the third pixel light segment group 230 is arranged in vertical direction above the second pixel light segment group 220 and the first pixel light segment group 210 is arranged in vertical direction beneath the second pixel light segment group 220.

It is to be noted that designations or respectively orientations such as "vertical" and "horizontal" refer to a motor vehicle headlamp system which is installed appropriately in a motor vehicle. Furthermore, in motor vehicle headlamp technology it is in any event known to a specialist in the art how these designations are to be understood, as light distribution of motor vehicle headlamps and their alignment are determined on a defined measuring screen, which according to ECE directives is situated 25 m from the motor vehicle headlamp or respectively motor vehicle headlamp system which is to be measured. The previously mentioned legal ECE directives also contain for example the terms vertical or respectively horizontal.

Figure 2:
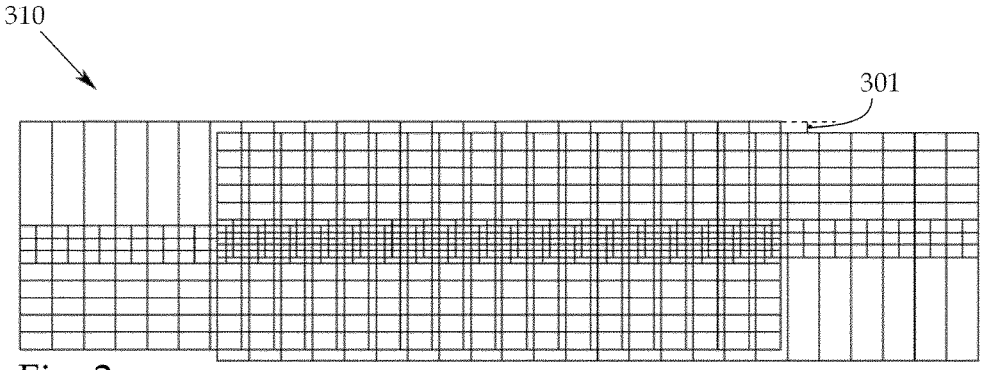

The first and the second light module of the first motor vehicle headlamp are furthermore arranged and disposed with respect to one another so that the first and the second light distribution 100, 200 of the first motor vehicle headlamp are arranged at least partially overlapping one another by a vertical offset 301 of a half of the second line height 120*b*, 220*b*, with the formation of a first headlamp light distribution 310, which first headlamp light distribution 310 is to be seen in FIG. 2. Furthermore, the first and the second light module of the first motor vehicle headlamp are arranged and disposed with respect to one another that the first and the second light distribution 100, 200 of the first motor vehicle headlamp additionally at least partially overlap one another by a horizontal offset of at least one quarter of the first column width 110*a*, 210*a*, so that the partially overlapping second pixel light segment groups 120, 220 of the first and second light distribution 100, 200 are arranged horizontally offset with respect to one another by a quarter of the first column width 110*a*, 210*a*.

Figure 3:
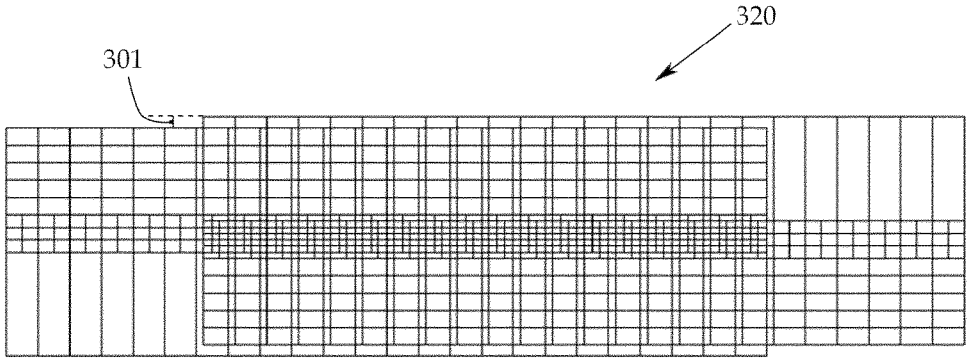

Furthermore, the first and the second light module of the second motor vehicle headlamp are arranged and disposed with respect to one another so that the first and the second light distribution 100, 200 of the second motor vehicle headlamp are arranged at least partially overlapping, with formation of a second headlamp light distribution 320, wherein the second headlamp light distribution 320 is horizontally mirrored with respect to the first headlamp light distribution 310, which second headlamp light distribution 320 is to be seen in FIG. 3.

Figure 4:
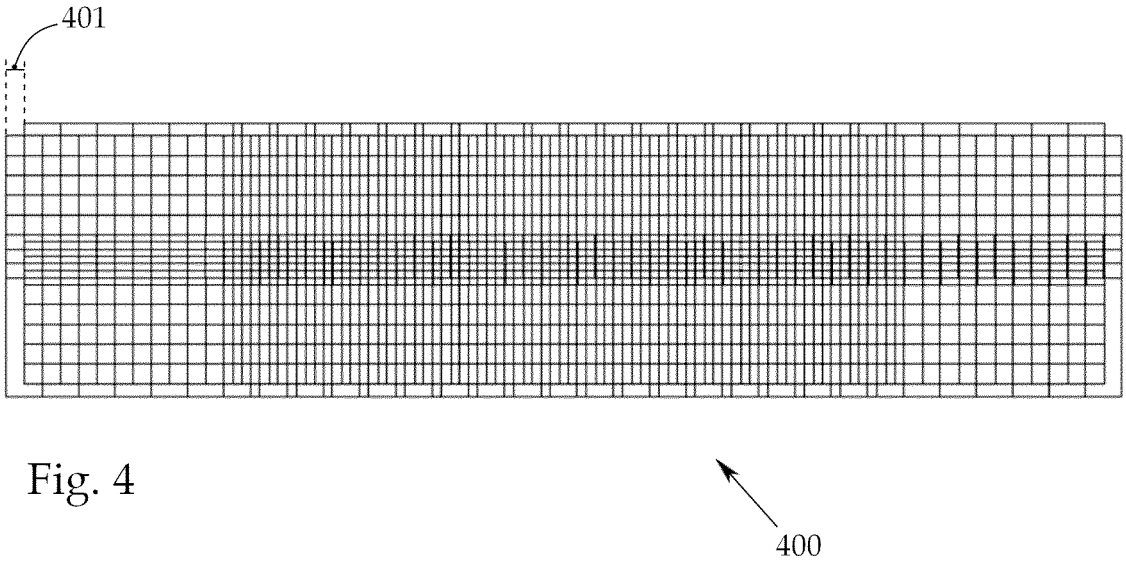

Moreover, the first and the second motor vehicle headlamp are arranged and disposed with respect to one another so that the first headlamp light distribution 310 of the first motor vehicle headlamp and the second headlamp light distribution 320 of the second motor vehicle headlamp are arranged overlapping one another by a horizontal offset 401 of by half the first column width 110*a*, 210*a* with formation of a motor vehicle headlamp system light distribution 400, which motor vehicle headlamp system light distribution 400 is to be seen in FIG. 4.

Moreover, the motor vehicle headlamp system comprises a control device (not illustrated), which is arranged to activate the light pixels of the first and second light modules such that in the motor vehicle headlamp system light distribution 400 a dipped beam distribution and/or a full beam distribution is able to be generated, wherein the light pixels are able to be activated independently of one another.

LIST OF REFERENCE NUMBERS

First light distribution . . . 100
Second light distribution . . . 200
Pixel light segment . . . 101, 201
First pixel light segment group . . . 110, 210
First column width . . . 110*a*, 210*a*
First line height . . . 110*b*, 210*b*
second pixel light segment group . . . 120, 220
second column width . . . 120*a*, 220*a*
second line height . . . 120*b*, 220*b*
third pixel light segment group . . . 130, 230
third column width . . . 130*a*, 230*a*
third line height . . . 130*b*, 230*b*
vertical offset . . . 301
first headlamp light distribution . . . 310
second headlamp light distribution . . . 320
Motor vehicle headlamp system light distribution . . . 400
Horizontal offset . . . 401

The invention claimed is:

1. A motor vehicle headlamp system comprising: with a first and a second motor vehicle headlamp, wherein each motor vehicle headlamp comprises a first and a second light module, which first light module comprises light pixels in a matrix-like arrangement in lines and columns, and is arranged to generate a first light distribution (100) before the motor vehicle headlamp system by radiating of light of individual light pixels, and wherein the second light module comprises light pixels in a matrix-like arrangement in lines and columns, and is arranged, by radiating of light of individual pixels, to generate a second light distribution (200) before the motor vehicle headlamp system, wherein each light distribution (100, 200) is formed from several pixel light segments (101, 201), wherein a pixel light segment (101, 201) corresponds to a light pixel and is able to be produced through this, wherein each light distribution (100, 200) is arranged to:

generate a first pixel light segment group (110, 210), which is arranged in a matrix-like manner in lines and columns with a first column width (110*a*, 210*a*) and a first line height (110*b*, 210*b*), generate a second pixel light segment group (120, 220), which is arranged in a matrix-like manner in lines and columns with a second column width (120*a*, 220*a*) and a second line height (120*b*, 220*b*), wherein the second column width (120*a*, 220*a*) corresponds to half the first column width (110*a*, 210*a*), and generate a third pixel light segment group (130, 230), which is arranged in a matrix-like manner in lines and columns with a third column width (130*a*, 230*a*) and a third line height (130*b*, 230*b*), which third column width corresponds to the first column width (110*a*, 210*a*), wherein in the first light distribution (100) of the first light module, the pixel light segment groups (110, 120, 130) are arranged over one another in vertical direction, wherein in vertical direction above the second pixel light segment group (120) the first pixel light segment group (110) is arranged and in vertical direction beneath the second pixel light segment group (120) the third pixel light segment group (130) is arranged, wherein the second light distribution (200) of the second light module is arranged mirrored vertically with respect to the first light distribution (100), so that the third pixel light segment group (230) is arranged in vertical direction above the second pixel light segment group (220) and the first pixel light segment group (210) is arranged in vertical direction beneath the second pixel light segment group (220), wherein the first and the second light module of the first motor vehicle headlamp are arranged and disposed with respect to one another, that the first and the second light distribution (100, 200) of the first motor vehicle headlamp are arranged at least partially overlapping one another by a vertical offset (301) of half the second line height (120*b*, 220*b*) with formation of a first headlamp light distribution (310), wherein the first and the second light module of the second motor vehicle headlamp are arranged and disposed with respect to one another, that the first and the second light distribution (100, 200) of the second motor vehicle headlamp at least partially overlap one another with formation of a second headlamp light distribution (320), wherein the second headlamp light distribution (320) is mirrored horizontally with respect to the first headlamp light distribution (310), and wherein the first and the second motor vehicle headlamp are arranged and disposed with respect to one another, that the first headlamp light distribution (310) of the first motor vehicle headlamp and the second headlamp light distribution (320) of the second motor vehicle headlamp overlap one another by a horizontal offset (401) of by half the first column width (110*a*, 210*a*) with formation of a motor vehicle headlamp system light distribution (400).

2. The motor vehicle headlamp system according to claim 1, wherein the first, second and third line heights are different from one another.

3. The motor vehicle headlamp system according to claim 1, wherein the first line height (110*b*, 210*b*) is greater than the second and the third line height (120*b*, 220*b*, 130*b*, 230*b*), and wherein the third line height (130*b*, 230*b*) is greater than the second line height (120*b*, 220*b*).

4. The motor vehicle headlamp system according to claim 1, wherein the light pixels of the first and second light modules are formed from LEDs.

5. The motor vehicle headlamp system according to claim 1, wherein the number of light pixels of a light module is a maximum of 400.

6. The motor vehicle headlamp system according to claim 1, wherein the light pixels of the first and second light modules are configured as mini LEDs.

7. The motor vehicle headlamp system according to claim 1, wherein the motor vehicle headlamp system comprises a control device, which is arranged to activate the light pixels of the first and second light modules, wherein the light pixels are able to be activated independently of one another.

8. The motor vehicle headlamp system according to claim 7, wherein the control device is arranged to activate the light pixels of the first and second light modules such that a dipped beam distribution and/or a full beam distribution is able to be generated in the motor vehicle headlamp system light distribution.

9. The motor vehicle headlamp system according to claim 1, wherein the first and the second light module of the first motor vehicle headlamp are arranged and disposed with respect to one another, that the first and the second light distribution (100, 200) of the first motor vehicle headlamp in addition at least partially overlap one another by a horizontal offset of at least one quarter of the first column width (110*a*, 210*a*).

10. The motor vehicle headlamp system according to claim 9, wherein the horizontal offset is a multiple of a quarter of the first column width (110*a*, 210*a*).

* * * * *